US008002042B2

(12) United States Patent
Going, III

(10) Patent No.: US 8,002,042 B2
(45) Date of Patent: Aug. 23, 2011

(54) ACTUATABLE SUBSURFACE SAFETY VALVE AND METHOD

(75) Inventor: Walter S. Going, III, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 242 days.

(21) Appl. No.: 12/049,773

(22) Filed: Mar. 17, 2008

(65) Prior Publication Data

US 2009/0229814 A1 Sep. 17, 2009

(51) Int. Cl.
*E21B 43/00* (2006.01)
*E21B 34/06* (2006.01)
*E21B 23/00* (2006.01)

(52) U.S. Cl. ..... 166/373; 166/66.6; 166/332.8

(58) Field of Classification Search ..... 166/66.6, 166/332.8, 373
See application file for complete search history.

(56) References Cited

U.S. PATENT DOCUMENTS

| | | | | |
|---|---|---|---|---|
| 4,002,202 A | | 1/1977 | Huebsch et al. | |
| RE30,110 E | | 10/1979 | Huebsch et al. | |
| 4,566,534 A | | 1/1986 | Going, III | |
| 4,579,177 A | | 4/1986 | Going, III | |
| 4,649,993 A | | 3/1987 | Going, III | |
| 4,796,708 A | | 1/1989 | Lembcke | |
| 4,997,043 A | * | 3/1991 | Pringle | 166/382 |
| 5,070,944 A | * | 12/1991 | Hopper | 166/66.7 |
| 5,529,281 A | * | 6/1996 | Brudnicki et al. | 251/129.03 |
| 6,433,991 B1 | | 8/2002 | Deaton et al. | |
| 6,619,388 B2 | | 9/2003 | Dietz et al. | |
| 6,877,564 B2 | * | 4/2005 | Layton et al. | 166/332.8 |
| 7,246,668 B2 | * | 7/2007 | Smith | 166/386 |
| 7,360,600 B2 | * | 4/2008 | MacDougall et al. | 166/332.8 |
| 7,363,980 B2 | * | 4/2008 | Pringle | 166/319 |
| 7,654,333 B2 | * | 2/2010 | Smith | 166/386 |
| 2002/0023759 A1 | * | 2/2002 | Deaton | 166/381 |
| 2006/0070744 A1 | * | 4/2006 | Smith | 166/386 |
| 2007/0137869 A1 | * | 6/2007 | MacDougall et al. | 166/386 |
| 2009/0032238 A1 | * | 2/2009 | Rogers et al. | 166/66.6 |
| 2009/0229814 A1 | * | 9/2009 | Going, III | 166/66.4 |
| 2010/0025045 A1 | * | 2/2010 | Lake et al. | 166/373 |

FOREIGN PATENT DOCUMENTS

GB 2240376 A * 7/1991

OTHER PUBLICATIONS

Going, W.S., et al. "Safety Valve Technology for the 1990's," SPE 18393, Society of Petroleum Engineers, London, UK, Oct. 18-19, 1988.

* cited by examiner

*Primary Examiner* — Jennifer H Gay
(74) *Attorney, Agent, or Firm* — Cantor Colburn LLP

(57) ABSTRACT

A downhole tool includes, a tubular, a tooth profile on the tubular, at least one first actuatable latch complementary to the tooth profile and at least one second actuatable latch complementary to the tooth profile. The at least one second actuatable latch prevents movement of the tubular when actuated. Additionally, at least one actuator is in operable communication with the at least one first actuatable latch such that actuation of the at least one actuator while the at least one first actuatable latch is actuated and the at least one second actuatable latch is nonactuated causes movement of the tubular.

19 Claims, 6 Drawing Sheets

ACTUATABLE SUBSURFACE SAFETY VALVE AND METHOD

BACKGROUND OF THE INVENTION

The hydrocarbon recovery industry utilizes downhole safety valves to safely shut off flow from wells where, for example, excessive downhole pressures could otherwise cause undesirably high flows to reach surface. The ability to remotely control the actuation of such valves is a desirable feature. Additionally, the ability to repeatedly open and close such valves, without retrieving the valve to surface, is also a desirable feature.

BRIEF DESCRIPTION OF THE INVENTION

Disclosed herein is a downhole tool. The downhole tool includes, a tubular, a tooth profile on the tubular, at least one first actuatable latch complementary to the tooth profile, at least one second actuatable latch complementary to the tooth profile that prevents movement of the tubular when actuated, and at least one actuator in operable communication with the at least one first actuatable latch such that actuation of the at least one actuator while the at least one first actuatable latch is actuated and the at least one second actuatable latch is non-actuated causes movement of the tubular.

Further disclosed herein is a subsurface safety valve. The subsurface safety valve includes, a housing, a tubular movable within the housing and in operable communication with a valve, at least one first profile engagement member that is engagable with the tubular, at least one second profile engagement member that is engagable with the tubular, and at least one actuator. The at least one actuator is in operable communication with the at least one first profile engagement member such that actuation of the at least one actuator while the at least one first profile engagement member is engaged with the tubular causes the tubular to move.

Further disclosed herein is a method of actuating a subsurface valve. The method includes, actuating a first actuator to engage at least one first latch with a tubular, actuating a second actuator to move the at least one first latch and the tubular in a first direction, actuating a third actuator to engage at least one second latch with the tubular to prevent movement of the tubular. The method further includes, deactivating the first actuator and the second actuator thereby allowing movement of at least the at least one first latch in a second direction, the second direction is opposite to the first direction, actuating the first actuator to engage the at least one first latch with the tubular, deactivating the at least one third actuator to disengage the at least one second latch with the tubular, and actuating the second actuator to move the at least one first latch and the tubular in the first direction.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
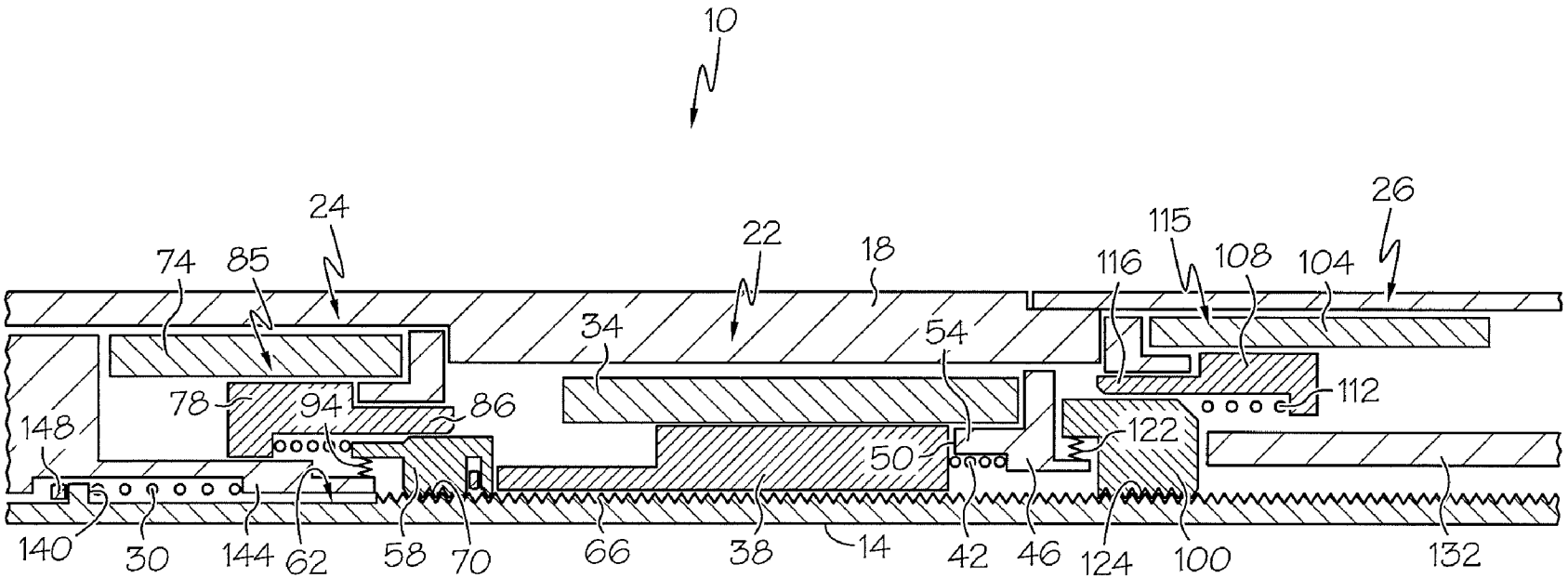
FIG. 1 depicts a partial cross sectional view of the solenoid actuated subsurface safety valve disclosed herein with the solenoids energized.
Figure 2:
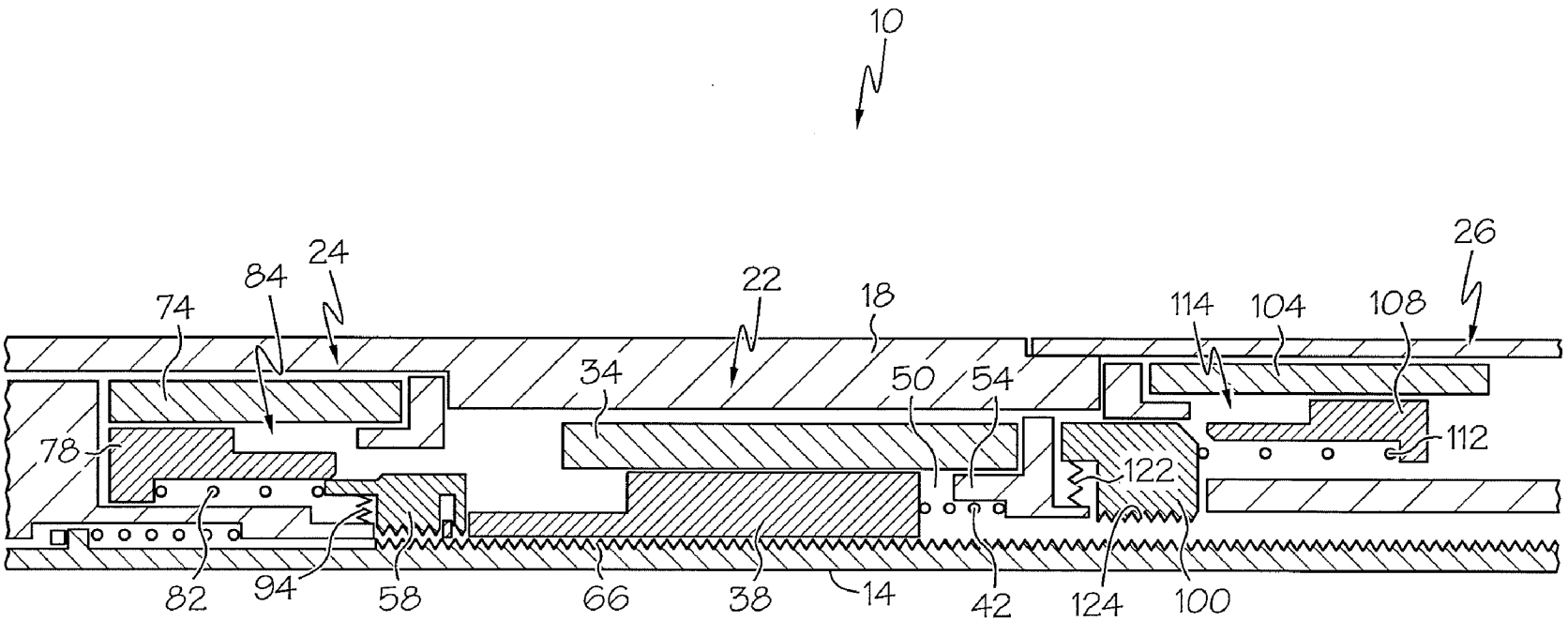
FIG. 2 depicts the partial cross sectional view of the safety valve of FIG. 1 with the solenoids de-energized.
Figure 4:
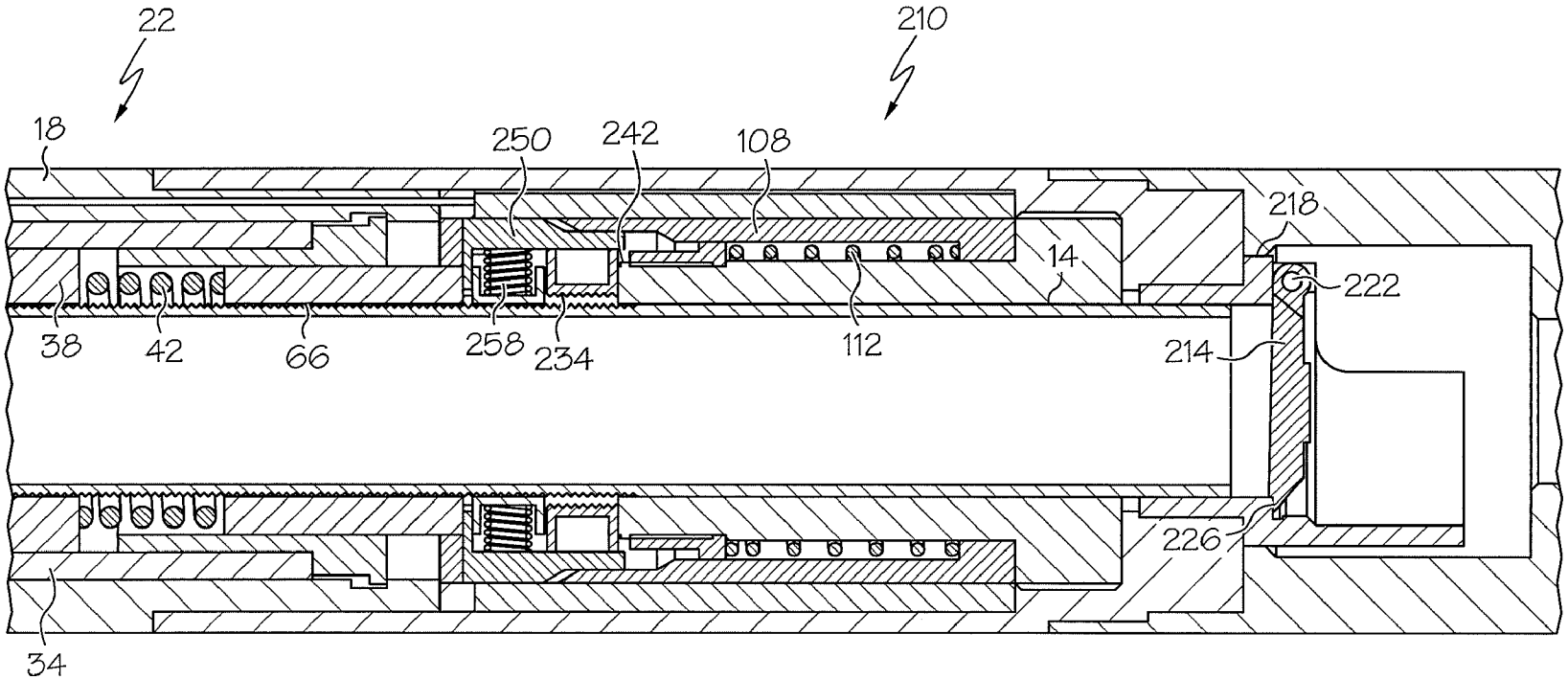
FIG. 4 depicts a cross sectional view of a second portion of the actuatable subsurface safety valve of FIG. 3.
Figure 6:
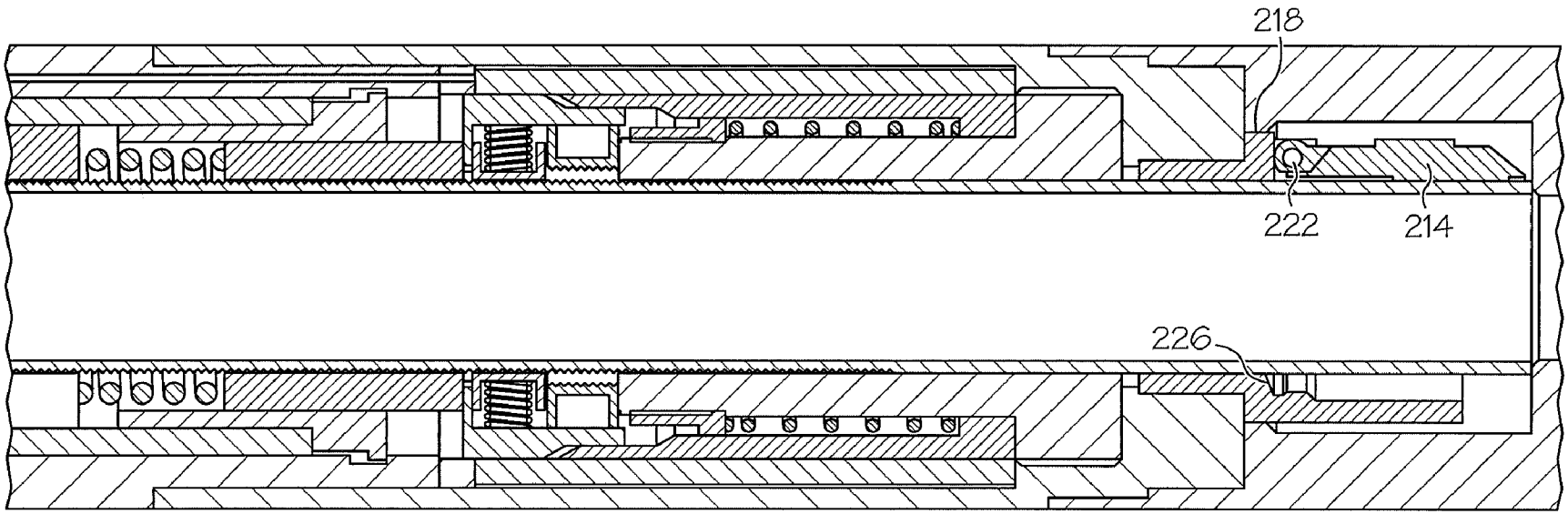
FIG. 6 depicts the cross sectional view of the second portion of the actuatable subsurface safety valve of FIG. 4 shown in an alternate state of actuation.

Referring to FIGS. 1 and 2, an embodiment of the actuatable subsurface safety valve 10, disclosed herein, is illustrated. The safety valve 10 includes, a longitudinally movable flow tube 14 positioned within a valve housing 18. The flow tube 14 is movable by three actuators 22, 24, 26, disclosed herein as solenoids, and a biasing member 30, disclosed herein as a power spring. Although the actuators 22, 24, 26 are disclosed herein as solenoids other actuators such as motorized ball-screws, or pistons, for example, could be used in alternate embodiments. The flow tube 14 is in operational communication with a flapper valve for example as shown in FIGS. 4 and 6, as is known in the industry and is actuatable through longitudinal movement of the flow tube 14.

The first actuator 22, hereinafter first solenoid, includes, a first coil 34, a first plunger 38, also referred to herein as first armature, and an urging member 42, also referred to herein as return spring. The first coil 34 is fixedly attached to the valve housing 18 and the first plunger 38 abuts a stop 46, which is attached to housing 18. The first armature 38 is biased in an uphole direction in this embodiment, by the return spring 42 that is compressed between the first armature 38 and the stop 46. Thus, in response to energization of the first solenoid 22 a magnetic field generated by current flowing through the first coil 34 urges the first armature 38 to move in a longitudinal direction, which in this embodiment is a downhole direction. The movement of the first armature 38 causes the return spring 42 to compress thereby increasing a biasing force applied to the first armature 38 from the return spring 42. A full stroke of the first armature 38 is defined by a gap 50 between the first armature 38 and a portion 54 of the stop 46.

The gap 50 is set to be small in comparison to a full travel distance of the flow tube 14 defined by the travel of the flow tube 14 from a fully closed position to a fully open position of the valve 10. Solenoids, by their nature generate more actuation force the smaller their stroke. Thus, by having a small stroke the first solenoid 22 is able to create large forces. These large forces are sufficient to overcome forces that urge the flow tube 14 in an opposite direction. Such forces may include, viscous drag on the flow tube 14 due to fluid flow therethrough, pressure acting on the upstream side of the valve and biasing forces acting on the flow tube 14 by the biasing member 30, for example. Since the stroke of the first solenoid 22 is small in comparison to the stroke of the flow tube 14, several strokes of the first solenoid 22 will be required to fully stroke the flow tube 14. Mechanics that permit the first solenoid 22 to stroke several times to actuate the valve 10 fully will be described below.

The first armature 38 is movably engaged with at least one first latch 58, also referred to herein as a profile engagement member that is engagable with tooth profile 66, on an outer surface 62 of the flow tube 14. Although the first latch 58 is disclosed herein as a profile engagement member other latching methods, such as frictional engagement of the first latch 58 with the flow tube 14 could be used in alternate embodiments. The first latch 58 has teeth 70 that are complementary to the teeth on tooth profile 66 such that when the first latch 58 is engaged with the tooth profile 66 the flow tube 14 is positionally locked with the first latch 58. As such, when the first latch 58 is engaged with the ratchet 66 movement of the first armature 38 in a downhole direction, for example, causes a corresponding downhole movement of the flow tube 14. When the second solenoid 24 is de-energized, however, the first latch 58 disengages from the tooth profile 66 of the flow tube 14 completely, thereby eliminating movement constraints on the flow tube 14 by the first latch 58.

An energization state of the second solenoid 24 determines whether or not the first latch 58 is actuated and engaged with the tooth profile 66 of the flow tube 14. The second solenoid 24 includes, a second coil 74, a second armature 78 and a biasing member 82, disclosed herein as a compression spring. The second armature 78 is biased by the biasing member 82 in an uphole direction, in this embodiment, and as such can move the second armature 78 into an uphole position 84 as shown in FIG. 2. Energization of the second solenoid 24 creates a magnetic field due to current flowing through the second coil 74 that urges the second armature 78 in a downhole direction and can therefore move the second armature 78 into a downhole position 85, as shown in FIG. 1. A portion 86 of the second armature 78, when in the energized position, displaces the first latch 58 radially inwardly compressing a biasing member 94, illustrated herein as a compression spring, in the process and thereby moving the first latch 58 into engagement with the flow tube 14. De-energization of the second solenoid 24 will consequently allow spring 94 to move the first latch 58 radially outwardly, thereby disengaging the first latch 58 from the tooth profile 66 of the flow tube 14. When the first latch 58 is disengaged with the flow tube 14, the flow tube 14 can be prevented from moving by engagement of a second latch 100, also referred to herein as a profile engagement member, that is selectively engagable with the ratchet 66 of the flow tube 14 in response to an energization state of the third solenoid 26. Although the second latch 100 is disclosed herein as a profile engagement member, other latching methods, such as frictional engagement of the second latch 100 with the flow tube 14 could be used in alternate embodiments.

The third solenoid 26 includes, a third coil 104, a third armature 108 and a biasing member 112, disclosed herein as a compression spring. The biasing member 112 urges the third armature 108 in a downhole direction, in this embodiment, and as such can move the third armature 108 to a downhole position 114, as shown in FIG. 2. Energization of the third solenoid 26 creates a magnetic field, due to current flowing through the third coil 104 that urges the third armature 108 in an uphole direction, in this embodiment, and can thereby move the third armature 108 into an uphole position 115, as shown in FIG. 1. When moved to the uphole position 115, a portion 116 of the third armature 108 moves the second latch 100 radially inwardly. Radial inward movement of the second latch 100 compresses a biasing member 122, disclosed herein as a compression spring, and moves teeth 124 of the second latch 100 into engagement with the tooth profile 66 of the flow tube 14. The second latch 100 is longitudinally fixed, relative to the valve housing 18, by the stop 46 and stop 132, which may be a part of the housing 18 or a separate component that is fixed relative to the housing 18. As such, whenever the third solenoid 26 is energized the second latch 100 becomes engaged with the flow tube 14. This engagement prevents uphole or downhole movement of the flow tube 14 relative to the valve housing 18. Alternately, when the third solenoid 26 is de-energized the biasing member 122 urges the second latch 100 radially outwardly thereby disengaging the teeth 124 from the tooth profile 66. Such disengagement removes any movement constraints placed on the flow tube 14 from the second latch 100.

Actuation of the safety valve 10 from a fully closed to a fully open position is carried out as follows. The second solenoid 24 is energized thereby engaging the first latch 58 with the flow tube 14. The first solenoid 22 is then energized which, in this embodiment, causes downhole longitudinal movement of the first armature 38 and corresponding downhole longitudinal movement of the first latch 58 and the flow tube 14 engaged therewith. After a full stroke of the first armature 38, the third solenoid 26 is energized, engaging the second latch 100 with the flow tube 14, thereby holding the flow tube 14 relative to the housing 18. Next, the first solenoid 22 and the second solenoid 24 are de-energized, thereby permitting the first armature 38 to reset through uphole movement thereof under the urging force of the return spring 42. The resetting of the first armature 38 causes a corresponding uphole movement of the first latch 58. Once both the first solenoid 22 and the second solenoid 24 are repositioned in the upward direction, the second solenoid 24 is re-energized, engaging the first latch 58 at which time the third solenoid 26 is de-energized, disengaging the second latch 100 positioning the valve 10 for another power stroke through energization of the first solenoid 22.

Through repetition of the above-described sequence, the valve 10 is actuated from a fully closed to a fully open position. The valve 10 will remain open as long as either of the two solenoids 24 and 26 is energized, thereby maintaining latching engagement of one of the first latch 58 and the second latch 100 with the flow tube 14. A cycle time to open the valve 10 will be a summation of the power strokes, the return strokes and the time to execute commands to cycle power on and off to the three solenoids 22, 24 and 26.

Closing the valve 10 from an opened configuration is accomplished by simply de-energizing at least the two solenoids 24 and 26. Once the solenoids 24 and 26 are de-energized, the springs 94 and 122 cause the latches 58 and 100 respectively, to disengage from the flow tube 14. With the latches 58, 100 disengaged from the flow tube 14 the flow tube 14 is free to move, in this embodiment, in an uphole direction, due to the urging force created by the power spring 30, positioned between a shoulder 140 of the flow tube 14 and a stop 144 fixedly attached to the housing 18. Such movement of the flow tube 14 allows the valve 10 to close. A cycle time to close the valve 10, from a fully opened configuration, will be a function of the ratio of the force of the spring 30 to the weight of the flow tube 14, if in a vertical orientation as disclosed herein. Such a cycle time should be less than one second. Note: a dampener 148 can be attached to a backside of the shoulder 140 to cushion the impact of the flow tube 14 against the stop 144 during closure of the valve 10.

Since de-energizing the solenoids 24, 26 causes the valve 10 to close, an operator will know if the valve 10 is closed by monitoring whether or not the solenoids 24, 26 are energized. Knowing whether or not the valve is fully open, however, is more difficult as several cycles of the first solenoid are required to fully open the valve 10. As such, a method to provide feedback to an operator when the valve 10 is fully open is desirable. Current flow through the first coil 18 can provide just such feedback. The current flow through the first coil 34 is affected by back electromagnetic fields (EMF) related to the position of the first armature 38 within the first coil 18. As such, by monitoring current flow to the first coil 18 an operator can tell when the first armature 38 ceases to move due to the flow tube 14 having traveled its full travel distance, which correlates to the valve 10 being fully open.

Figure 3:
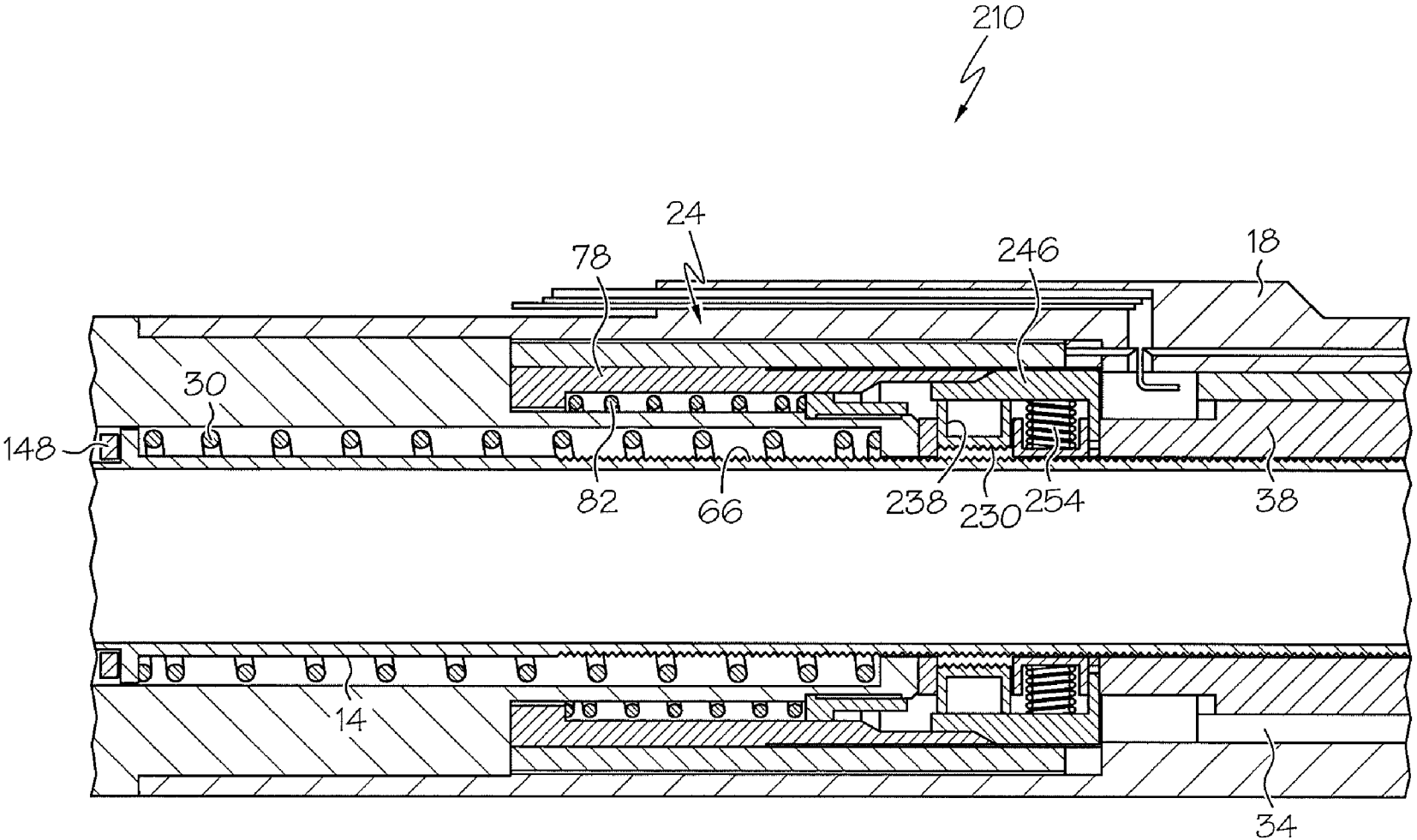
FIG. 3 depicts a cross sectional view of a first portion of an alternate embodiment of an actuatable subsurface safety valve.
Figure 5:
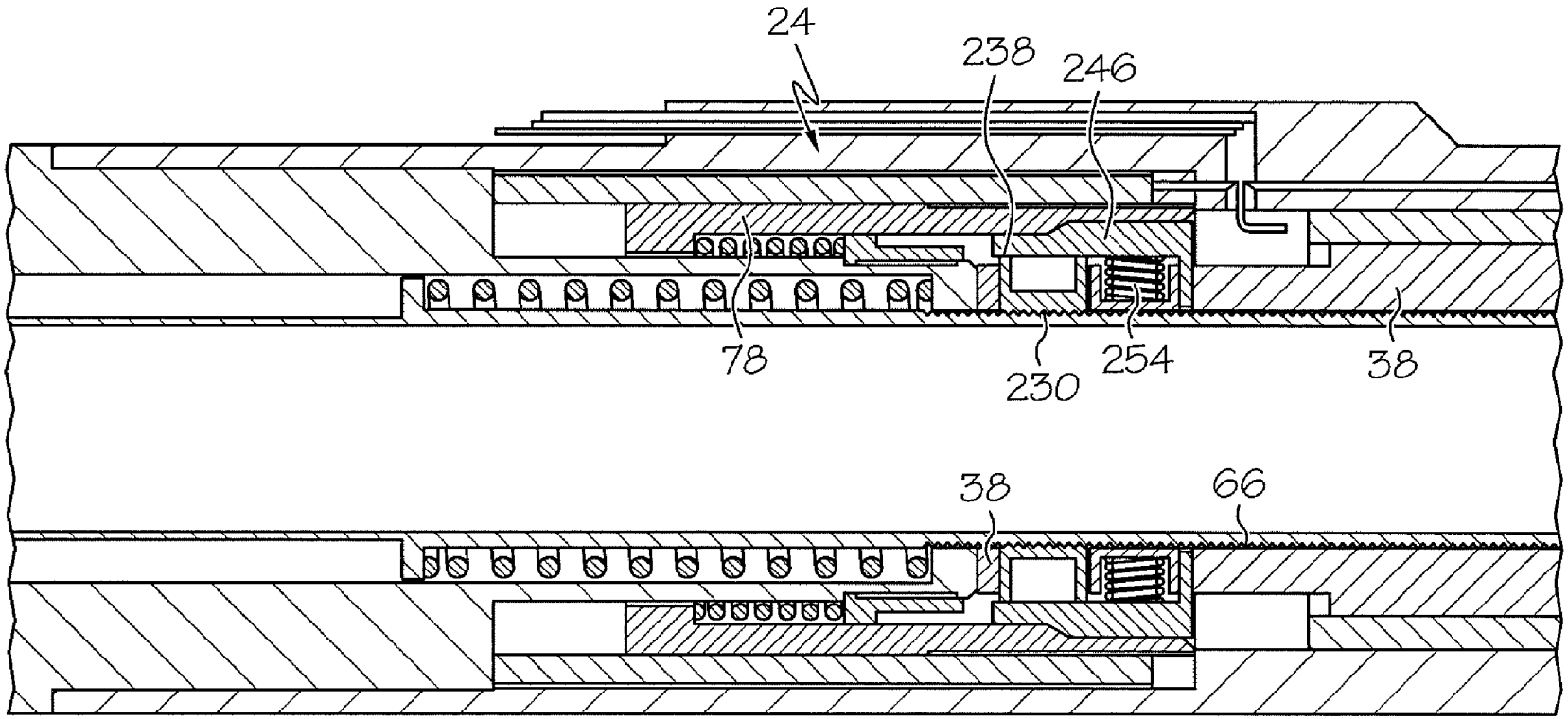
FIG. 5 depicts the cross sectional view of the first portion of the actuatable subsurface safety valve of FIG. 3 shown in an alternate state of actuation.

Referring to FIGS. 3-6, an alternate embodiment of the safety valve 210 is illustrated. Features of the valve 210 that are similar to those of the valve 10 are identified by the same reference characters and will not be described again here. FIGS. 3 and 4 show a flapper 214 in a closed position with flow tube 14, and FIGS. 5 and 6 show the flapper 214 in an open position with flow tube 14. The flapper 214 pivots within flapper housing 218 about hinge pin 222 and seals against valve seat 226 when closed.

A primary distinction between the valve 210 and the valve 10 is the configuration of the first latch and the second latch. In the valve 10 the first latch 58 and the second latch 100 have teeth 70 and 124 integrated into a portion of the latch 58 and 100 respectively. In the valve 210, teeth 230 and 234 are located on holding dogs 238 and 242 respectively, which are positioned radially by first latch 246 and second latch 250 respectively. As such, the teeth 230 are moved into and out of engagement with tooth profile 66 in response to the holding dog 238 being moved radially inwardly and radially outwardly by the first latch 246, which is biased radially outwardly by biasing member 254, illustrated herein as a compression spring. Similarly, the teeth 234 are moved into and out of engagement with tooth profile 66 in response to the holding dog 242 being moved radially inwardly and radially outwardly by the second latch 250, which is biased radially outwardly by biasing member 258, illustrated herein as a compression spring. As in valve 10, in valve 210 the first latch 246 and the second latch 250 are moved radially inwardly by second armature 78 and third armature 108 respectively. FIG. 3 depicts the second solenoid 24 in a non-energized configuration, while FIG. 5 depicts the second solenoid 24 in an energized configuration. As such, the teeth 230 are not engaged with the tooth profile 66 in FIG. 3, while the teeth 230 are engaged with the tooth profile 66 in FIG. 5.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole tool comprising:
- a tubular;
- a tooth profile on the tubular;
- at least one first actuatable latch complementary to the tooth profile;
- at least one second actuatable latch complementary to the tooth profile that prevents movement of the tubular when actuated; and
- at least one actuator in operable communication with the at least one first actuatable latch such that actuation of the at least one actuator while the at least one first actuatable latch is actuated and the at least one second actuatable latch is nonactuated causes movement of the tubular.

2. The downhole tool of claim 1, wherein the tool further comprises a bias that resists the movement of the tubular.

3. The downhole tool of claim 1, wherein the at least one actuator is a solenoid.

4. The downhole tool of claim 1, wherein the tool further comprises a bias for at least one of the at least one first actuatable latch and the at least one second actuatable latch.

5. The downhole tool of claim 1, wherein the tool further comprises a bias to urge at least one of the at least one first actuatable latch and the at least one second actuatable latch out of engagement with the tooth profile.

6. The downhole tool of claim 1, wherein the tool further comprises a housing within which the tubular and the at least one first actuatable latch and the at least one second actuatable latch are housed.

7. The downhole tool of claim 1, wherein the tubular is a flow tube of a safety valve.

8. The downhole tool of claim 1, wherein actuation of at least one of the at least one first actuatable latch and the at least one second actuatable latch is controlled by a solenoid.

9. A subsurface safety valve, comprising:
- a housing;
- a tubular movable within the housing and in operable communication with a valve;
- at least one first profile engagement member that is engagable with the tubular;
- at least one second profile engagement member that is engagable with the tubular and prevents movement of the tubular in both longitudinal directions when engaged therewith; and
- at least one actuator in operable communication with the at least one first profile engagement member such that actuation of the at least one actuator while the at least one first profile engagement member is engaged with the tubular causes the tubular to move.

10. The subsurface safety valve of claim 9, wherein the actuator is a solenoid.

11. The subsurface safety valve of claim 9, wherein engagement of at least one of the at least one first profile engagement member and the at least one second profile engagement member is controlled by a solenoid.

12. A method of actuating a subsurface valve, comprising:
- actuating a first actuator to engage at least one first latch with a tubular;
- actuating a second actuator to move the at least one first latch and the tubular in a first direction;
- actuating a third actuator to engage at least one second latch with the tubular to prevent movement of the tubular;
- deactivating the first actuator and the second actuator thereby allowing movement of at least the at least one first latch in a second direction, the second direction being opposite to the first direction;
- actuating the first actuator to engage the at least one first latch with the tubular;
- deactivating the at least one third actuator to disengage the at least one second latch with the tubular; and
- actuating the second actuator to move the at least one first latch and the tubular in the first direction.

13. The method of claim 12 further comprising opening a valve with the movement of the tubular.

14. The method of claim 13 further comprising:
- deactivating at least the first actuator and the second actuator;
- moving the tubular in the second direction with a biasing member; and
- closing a valve with the movement of the tubular in the second direction.

15. The method of claim 12 wherein the actuating of at least one of the first actuator, the second actuator and the third actuator further comprises energizing a solenoid.

16. The method of claim 15 wherein the energizing the solenoid further comprises moving an armature to displace at least one of the first latch and the at least one second latch in a radial direction.

17. The method of claim 16 wherein the resetting further comprises moving the armature in response to releasing energy stored in a biasing member.

18. The method of claim 15 further comprising resetting the solenoid in response to removing energy from the solenoid.

19. The method of claim 18 wherein the resetting further comprises moving the at least one first latch and the at least one second latch in a radial direction.

* * * * *